US010787818B2

(12) United States Patent
Schultz et al.

(10) Patent No.: US 10,787,818 B2
(45) Date of Patent: Sep. 29, 2020

(54) METHOD OF MANUFACTURING REINFORCED SIDING PANELS

(71) Applicant: CertainTeed LLC, Malvern, PA (US)

(72) Inventors: Ashley A. Schultz, Jackson, MI (US); Robert D. Shaw, Parma, MI (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/370,492

(22) Filed: Mar. 29, 2019

(65) Prior Publication Data

US 2019/0301174 A1 Oct. 3, 2019

Related U.S. Application Data

(60) Provisional application No. 62/651,097, filed on Mar. 31, 2018.

(51) Int. Cl.
*E04F 13/08* (2006.01)

(52) U.S. Cl.
CPC ..... *E04F 13/0864* (2013.01); *E04F 13/0876* (2013.01)

(58) Field of Classification Search
CPC ... E04F 13/075; E04F 13/077; E04F 13/0866; E04F 13/0876; E04F 13/0864; E04F 13/12; E04F 13/18; E04F 13/0889
See application file for complete search history.

(56) References Cited

U.S. PATENT DOCUMENTS 3,159,943 A * 12/1964 Sugar ..... E04F 13/0864 52/278
3,468,086 A * 9/1969 Warner ..... E04D 3/351 52/173.1
4,586,304 A 5/1986 Flamand
5,869,176 A * 2/1999 Dorchester ..... B29C 48/175 428/327
6,029,415 A * 2/2000 Culpepper ..... E04F 13/0864 52/522
6,050,041 A * 4/2000 Mowery ..... E04F 13/18 52/506.05
6,195,952 B1 * 3/2001 Culpepper ..... E04F 13/0864 52/522
7,021,018 B2 4/2006 Peng
8,091,313 B2 * 1/2012 Wilson ..... E04F 13/007 52/302.1

(Continued)

*Primary Examiner* — Babajide A Demuren
(74) *Attorney, Agent, or Firm* — McDonnell Boehnen Hulbert & Berghoff LLP

(57) ABSTRACT

One aspect of the disclosure is a method of manufacturing a siding panel including providing a siding panel having a front face, a rear face, top edge, a bottom edge, a first side edge, and a second side edge, providing a support member having a top edge, a bottom edge, two side edges, a first face, and a second face, applying adhesive on a first face of the support member from one side edge of the support member to the other side edge of the support member, placing the support member on the rear face of the siding panel so the support member extends substantially from the first side edge to about ½ in. to about 2¼ in. away from the second side edge, completely securing the two side edges of a support member to the rear face of the siding panel, and laminating the support member to the siding panel.

20 Claims, 6 Drawing Sheets

(56) References Cited

U.S. PATENT DOCUMENTS

| | | | | |
|---|---|---|---|---|
| 8,381,472 | B1 * | 2/2013 | Fleenor | E04F 13/0825 52/459 |
| 9,097,024 | B2 | 8/2015 | Culpepper | |
| 2002/0029537 | A1 * | 3/2002 | Manning | E04F 13/0864 52/518 |
| 2005/0081468 | A1 * | 4/2005 | Wilson | E04F 13/007 52/528 |
| 2006/0075712 | A1 | 4/2006 | Gilbert | |
| 2007/0212970 | A1 | 9/2007 | Rockwell | |
| 2010/0132289 | A1 * | 6/2010 | Mahaffey | E04F 13/0864 52/309.8 |
| 2011/0197530 | A1 * | 8/2011 | Bahnmiller | B32B 5/14 52/309.4 |
| 2016/0208498 | A1 * | 7/2016 | Martin | E04F 13/0864 |
| 2018/0202167 | A1 * | 7/2018 | Culpepper | E04F 13/077 |

* cited by examiner

METHOD OF MANUFACTURING REINFORCED SIDING PANELS

CROSS-REFERENCE TO RELATED APPLICATIONS

This application claims the benefit of priority of U.S. Provisional Patent Application No. 62/651,097, filed Mar. 31, 2018, which is hereby incorporated herein by reference in its entirety.

BACKGROUND OF THE DISCLOSURE

1. Field of the Disclosure

The present disclosure relates generally to siding panels. The present disclosure relates more particularly to reinforced siding panels and method of manufacture.

2. Technical Background

Vinyl siding is commonly used in construction as the exterior cladding for homes and other structures, and has the advantage of low maintenance, easier installation, and high resistance to weathering when compared to composite siding. Vinyl siding is easily applied by home remodelers and do-it-yourselfers. Adjacent panels are overlapped side by side along a surface, creating a number of overlapped or "lapped" areas once installed. Ideally, the overlap/lap appearance should not be noticeable, and should remain so over time. However, the method by which the siding panels are manufactured, as well as defects or damage to the siding panels prior to installation can lead to poor lap appearance both initially and over time.

In order to provide vinyl siding panels a more updated and sophisticated look, and to standardize sizing, some vinyl siding panels can be made with wider profiles. These updated vinyl panels are often backed with a reinforcement or support member to provide additional rigidity to the thin panels. The support member is generally secured to the siding panel using an adhesive. The specific application and placement of the adhesive and support member have been found to have a significant effect on lap appearance.

SUMMARY OF THE DISCLOSURE

One aspect of the disclosure is a method for manufacturing a siding panel comprising:

providing a siding panel having a front face, a rear face, top edge, a bottom edge, a first side edge, and a second side edge;

providing a support member having a top edge, a bottom edge, a first side edge, a second side edge, a first face, and a second face;

applying adhesive on a first face of the support member from the first side edge of the support member to the second side edge of the support member;

placing the support member on the rear face of the siding panel; and completely securing the first side edge and the second side edge of the support member to the adhesive; thus laminating the support member to the siding panel, such that the adhesive directly laminates the first edge of the support member to the siding panel with no gap therebetween and the second side edge of the support member to the siding panel with no gap therebetween.

In certain embodiments, the adhesive is applied over at least one of the side edges of the support member.

Another aspect of the disclosure is a siding panel as described herein. The siding panel includes:

a front face;

a rear face having a support member completely secured thereto, the support member having adhesive on a first face of the support member from a first side edge of the support member to a second side edge thereof, such that the adhesive directly laminates the first side edge of the support member to the siding panel with no gap therebetween and the second side edge of the support member to the siding panel with no gap therebetween;

a top edge including a nail hem;

a bottom edge;

a first side edge; and a second side edge;

wherein the support member ends below the nail hem

In certain embodiments of the methods and panels described here, the support member is positioned such that it extends substantially from the first side edge of the siding panel (e.g., within ¼ inch) to about ½ in. to about 2¼ in. away from the second side edge of the siding panel. However, in other embodiments, the support member is positioned such that each of the first and second side edges of the support panel is positioned within about ½ inch to about 2¼ inches way from the respective side edge of the siding panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

Figure 1:
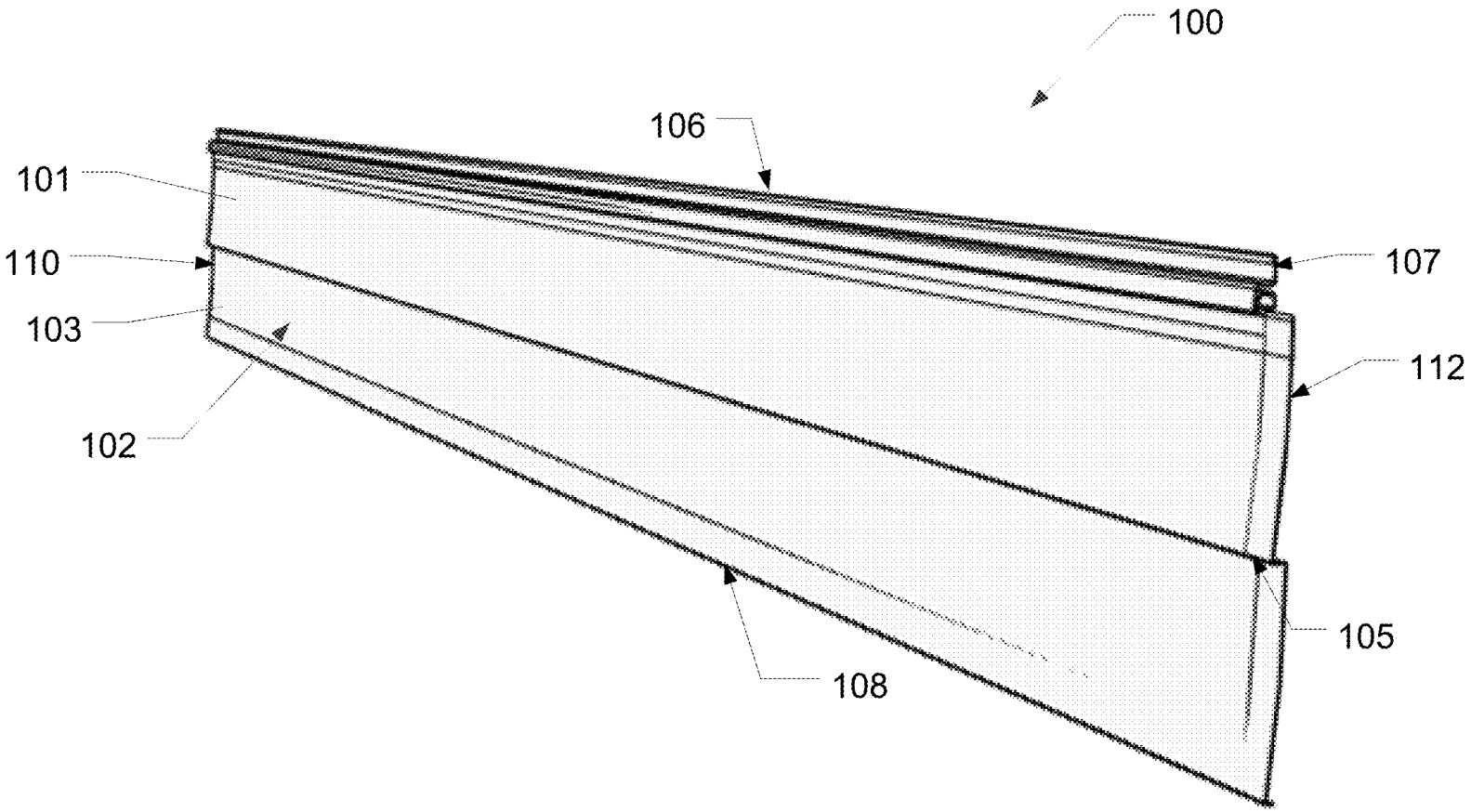
FIG. 1 is a schematic perspective view of an example reinforced siding panel according to one embodiment of the disclosure.

The present inventors have noted disadvantages of conventional methods of manufacturing reinforced siding panels. Generally, the reinforced panels include a reinforcement or support member secured to the back of the panel by an adhesive. The adhesive is typically placed in the center of the support member and set back from each side edge, leaving about 2 inches between the adhesive and each side edge of the support member. Therefore, the panels are bi-directional and can be installed on either side of an existing or previously installed panel, which can be helpful if an installer wishes to hide the overlap of the panels in lesser seen areas of the surface. To install the panels, the side edge of one panel is overlapped with a side edge of an adjacent panel by placing the side edge between the support member and rear face of the adjacent panel, and the two panels are then pushed together. Therefore, in such conventional panels, the edge of the support member cannot be fully adhered to the rear face of the panel, in order to allow space for an adjacent panel edge to be inserted. The support member also extends above the top edge and nail hem of the panel to provide insulation for the siding panels. The portion of the support member that extends over the nail hem is not secured to the panel with the adhesive. This lapping style creates initial and long-term lap appearance challenges, particularly for thinner, reinforced siding.

The present inventors have noted that the installation of typical reinforced panels as described above is difficult and time consuming to install, due to the force required to fit an edge of one panel into the small area between the support member and rear face of an adjacent panel. The present inventors have also noted that the placement of the adhesive, while ensuring that the support member is completely secured to the rear face of the siding panel, also plays a large role in increased quality of the siding panels before and after installation, as well as improved overlap appearance in comparison to the traditional lapping method.

Accordingly, one aspect of the disclosure is a method of manufacturing a siding panel with an attached support member by placing adhesive all the way up to, and in some cases even over, one or both of the side edges of the support member. Accordingly, in certain aspects of the disclosure, the adhesive directly laminates the edges of the support member to the siding panel with no gap therebetween. The present inventors have noted that even a small margin of error (e.g., of 3/16 inch) is unacceptable. Rather, there can be no measurable setback of the adhesive with respect to the siding panel. As mentioned above, the placement of the adhesive in this manner can lead to increased quality of the siding panels before and after the initial installation, as well as the same satisfactory overlap appearance after being exposed to extreme temperature conditions. Additionally, ensuring that the support member is and remains completely secured or adhered to the rear face of the panel also leads to retaining high quality lap appearance over time. The present inventors have determined that even a small gap in adhesion at side edges of a support member can result in unsatisfactory appearance over time when the siding panel is installed on a wall.

Figure 2:
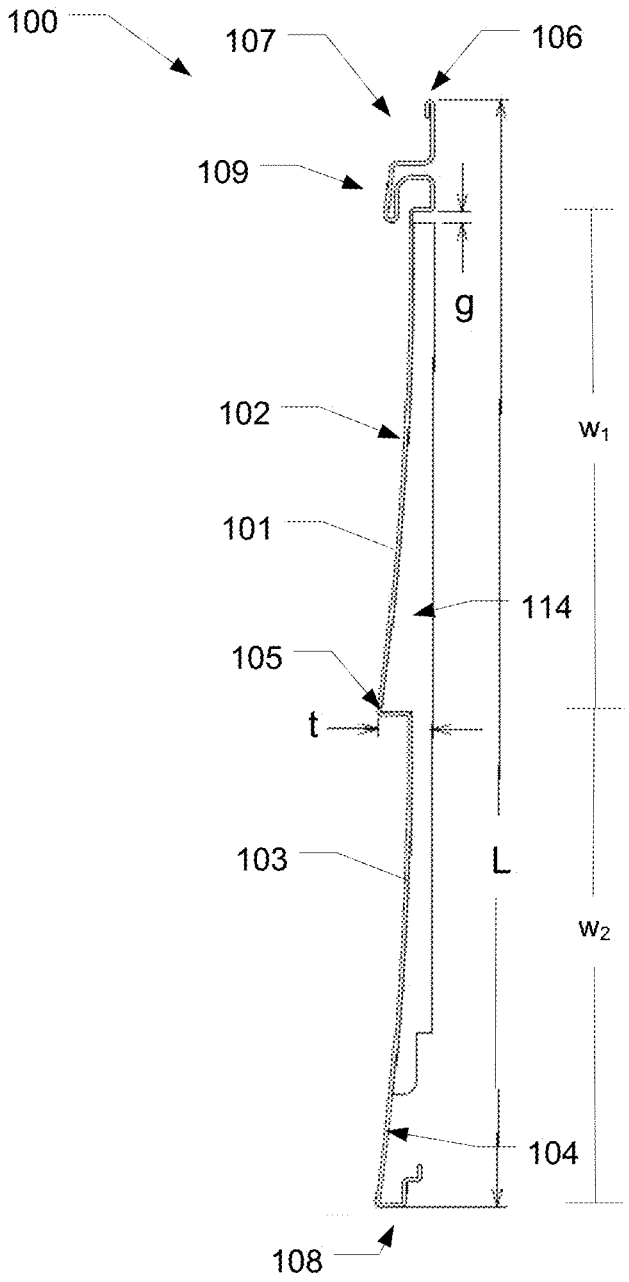
FIG. 2 is a schematic side view of the reinforced siding panel according to the embodiment shown in FIG. 1.

One embodiment of such a method is described with respect to FIGS. 1-4 below. FIGS. 1-2 show an example siding panel 100. In some embodiments, the siding panel is a vinyl siding panel which is interlocked and overlapped with one or more adjacent vinyl siding panels. As shown in FIGS. 1 and 2, the siding panel 100 may comprise a front face 102 and a rear face 104, opposite the front face. The front face 102 has an upper region 101 and a lower region 103, separated by an abutment 105. In some embodiments, as shown in FIG. 2, the width $w_1$ of the upper region 101 is in the range of about 2 in. to about 10 in., for example. In some embodiments, the width $w_2$ of the lower region 103 is in the range of about 2 in. to about 10 in., for example. In certain embodiments as otherwise described herein, the siding panel can have more or less regions having various widths. Additionally, the abutment 105 is smaller than that of standard vinyl siding, such as from about 3/16 in. to about 7/16 in., which provides an updated look and allows the support member to be thinner (described below).

The siding panel 100 further includes a top edge 106 and a bottom edge 108 opposite the top edge. As shown in FIGS. 1 and 2, the top edge 106 includes a nail hem 107 for receiving one or more fasteners to fasten the siding panel 100 to a surface. The nail hem 107 is overlapped and concealed by the next higher course of siding. The siding panel 100 also includes a first side edge 110 and a second side edge 112 opposite the first side edge. It should be understood that although the first side 110 is shown as being on the left side of the panel 100 and the second side 112 is shown as being on the right side of the panel, the first side and second side could be reversed.

Referring to FIG. 2, a reinforcing or support member 114, such as a piece of foam, is secured to the rear face 104. The support member 114 provides support and rigidity to the siding panel 100 to prevent deformation, as well as to support wider regions 101, 103, which provide a more sophisticated overall appearance. The support member 114 is secured along a portion of the length L of the siding panel 100. For example, in some embodiments, the support member 114 may have a length of about 2 in. to about 24 in. In certain embodiments as otherwise disclosed herein, the support member 114 is spaced apart, or gapped g, from about 0 in. to about 1 in. away from a top of the upper region 101. In certain embodiments as otherwise disclosed herein, the support member 114 extends from about ¼ in. to about 5 in. away from the top edge 106. In certain embodiments, the support member 114 extends from about 0 in. to about 8 in. away from the bottom edge 108. Alternatively, in some embodiments, the support member 114 may be secured along the entire length L of the siding panel, or beyond the length L of the siding panel. In some embodiments, the support member 114 may have a thickness t at its largest section of about ⅛ in. to about ¾ in.

In certain embodiments as otherwise described herein, the support member 114 is secured to the rear face 104 of the siding panel 100 using an adhesive (not shown). In certain embodiments as otherwise disclosed herein, an example adhesive may include a hot melt moisture cured adhesive. In other embodiments, any hot melt moisture cured adhesives, any hot melt adhesives, any pressure-sensitive adhesives, any contact adhesives, any adhesive films, any solvent-based adhesives, any two-part adhesives, any water-based adhesives, any cyanoacrylate adhesives or combinations thereof may be used. The adhesive may be applied in any known manner, such as by a roller, sprayed on, extrusion, slot-die coating, etc.

Figure 3:
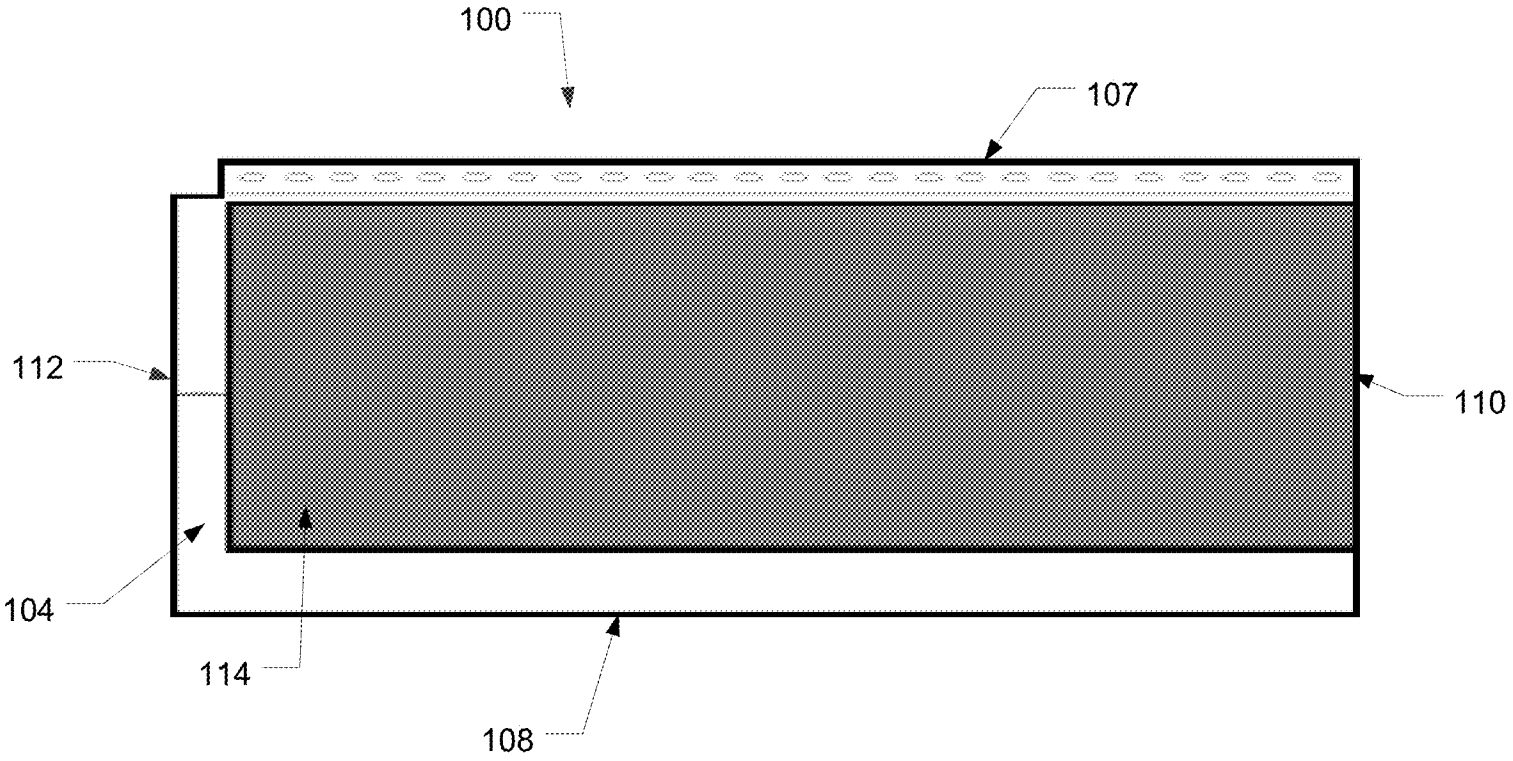
FIG. 3 is schematic rear view of the placement of a support member on the rear face of the siding panel shown in FIG. 1.

FIG. 3 shows the general placement of the support member 114 on the rear face 104 of the siding panel 100. The adhesive is placed all the way up to and in some cases including (over) one or both of the side edges of the support member 114. The adhesive is also placed in the range of about 0 in. to about 1 in. away from the top and bottom edges of the support member.

The support member 114 is then placed on the siding panel 100 with the adhesive side facing the rear face 104 of the panel 100. The support member 114 is placed on the rear face 104 of the siding panel so the support member extends from the first side edge 110 of the panel to about % in. to about 2¼ in. away from the second side edge 112 of the panel. The siding panel 100 and the support member 114 are then laminated together. There is no set back area between the placement of the adhesive and the support member 114 on the panel 100. It should be understood that in instances where adhesive does not cover the entire rear face 104, such as a spray or other method of application that includes small areas not covered, the support member will not adhere to the portion(s) of the rear face that contain(s) no adhesive.

Additionally, after the placement of the adhesive, the siding panel should be applied to the adhesive side of the support member 114 in a timely manner so that the support member can fully and completely adhere to the rear face 104. More specifically, both side edges of the support member 114 should be completely adhered to the rear face 104. In some embodiments, the adhesive has a short timeframe between when it is applied and when it cools and hardens. Once the adhesive hardens, some or all of the adhesion properties may be lost. Therefore, during the manufacturing process, the support member 114 should be secured to the adhesive during the short timeframe before the adhesive hardens and cools.

Figure 4:
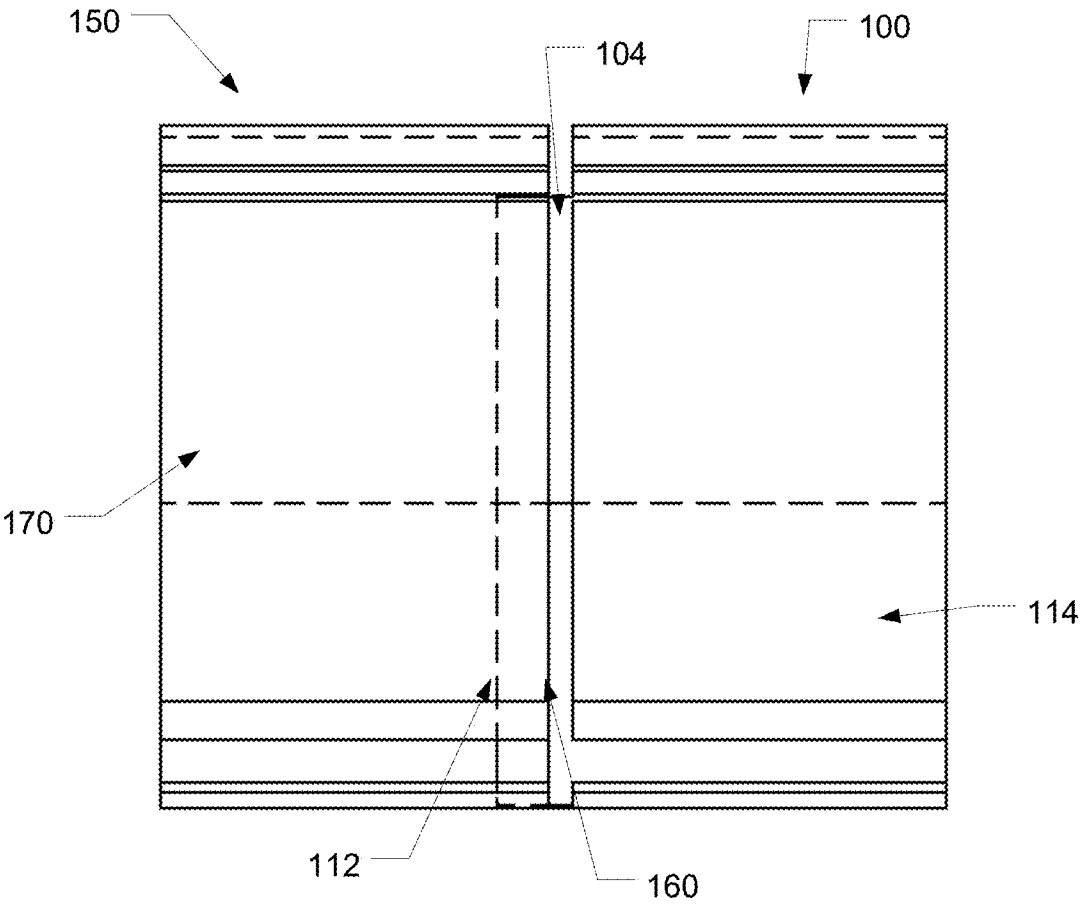
FIG. 4 is a schematic rear view of the ends of two siding panels being overlapped together.

As shown in FIG. 4, during installation, two adjacent siding panels 100, 150 are overlapped at their side edges. Specifically, the second side edge 112 of the first panel 100 is overlapped with the first side edge 160 of the second panel 150. The support member 170 of the second panel 150 extends all the way to the first side edge 160, and fits under the rear face 104 of the first panel 100. Since the support members extend substantially all the way to one edge of the panel, the panels can only be overlapped in one direction. Once overlapped, the panels can be secured to the surface by any suitable fastener, such as by nailing the panels to the surface. The same method can be repeated for each additional panel.

As noted above, in certain embodiments, the first edge of the support member is disposed substantially at the first edge of the siding panel. In certain embodiments, the first edge of the support member is flush with the first edge of the siding panel. However, there can be some lateral distance between these first edges. For example, in certain embodiments, the first edge of the support member is within ¼ inch of the first edge of the siding panel, e.g., in one embodiment with the siding panel extending beyond the support member, and in another embodiment with the support member extending beyond siding panel.

As noted above, the first edge of the support member is directly laminated to the siding panel with no gap therebetween. That is, at the first edge of the support member, the adhesive completely fills the interface between the support member and the siding panel. For example, in certain embodiments, the adhesive completely fills the interface between the first edge of the support member and the siding panel for a distance of at least one inch (i.e., as measured toward the second edge). In certain embodiments, as noted above, the adhesive is disposed over the first side edge of the support member (e.g., on a lateral surface thereof). And in certain embodiments, (e.g., when the first edge of the siding panel extends beyond the first end of the support member), the adhesive extends along the side panel beyond the second edge of the support member.

As noted above, the second edge of the support member is directly laminated to the siding panel with no gap therebetween. That is, at the second edge of the support member, the adhesive completely fills the interface between the support member and the siding panel. That is, there is no manufacturing tolerance for the disposition of adhesive to fail to completely adhere the second edge of the support member to the siding panel. For example, in certain embodiments, the adhesive completely fills the interface between the second edge of the support member and the siding panel for a distance of at least one inch (i.e., as measured toward the first edge). In certain embodiments, as noted above, the adhesive is disposed over the second side edge of the support member (e.g., on a lateral surface thereof). And in certain embodiments, the adhesive extends along the side panel beyond the second edge of the support member (e.g., by at least 1/16 inch, or even by at least ⅛ inch).

Figure 5:
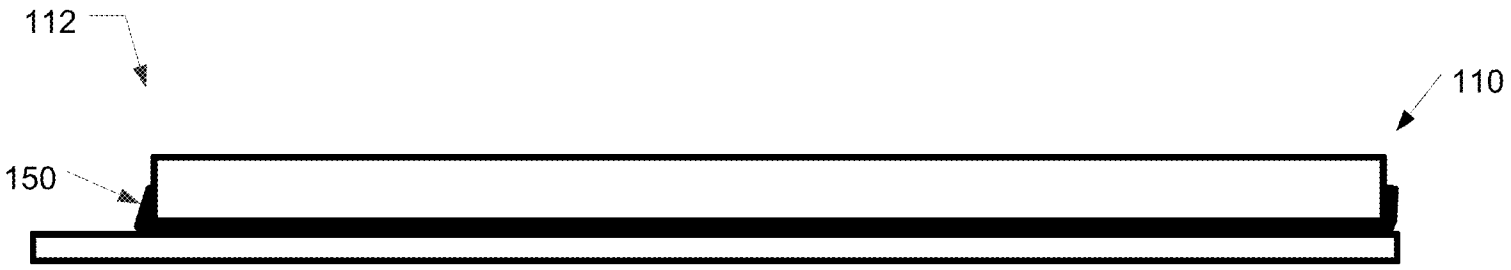
FIG. 5 is a schematic cross-sectional view of the adhesion of a support member to a siding panel.

FIG. 5 is a schematic cross-sectional view of a siding panel as otherwise described herein. Here, adhesive 150 is shown extending completely to the first edge 110 and the second edge 112 of the support member. In this embodiment, the adhesive is disposed over both side edges of the support member (here, on the lateral edges); while the adhesive over the edges does not adhere to anything, it does ensure that the edges are completely adhered to the siding panel as described herein.

In certain embodiments, as described above, the support member is positioned such that it extends substantially from the first side edge of the siding panel (e.g., within ¼ inch) to about ½ in. to about 2¼ in. away from the second side edge of the siding panel.

However, in other embodiments, the support member is positioned such that each of the first and second side edges of the support panel is positioned within about % inch to about 2¼ inches way from the respective side edge of the siding panel. In such embodiments, when the panel is to be installed, one edge of the siding panel can be trimmed back so the first edge of the support member is substantially in alignment with the first edge of the siding panel (e.g., within ¼ inch thereof). Such panels can be sued with lapping in either direction, to be selected by the end user by selecting which end to trim off.

While the siding panels shown herein are shaped to appear like two planks of siding, the person of ordinary skill in the art will appreciate that other shapes can be used, e.g., to appear like a single plank of siding, or to appear like more than two planks of siding.

The siding panel of FIG. 2 is shown has having a locking channel, which can interact with a feature disposed at the bottom of the panel to help secure vertically-adjacent panels to form a continuous cladding. Such a panel can include a retaining loop 109 configured to retain an engagement portion 116. Retaining loops and engagement portions suitable for use in the siding panels described herein are described in detail in U.S. Patent Application Publication no. 2018/0187421, which is hereby incorporated herein by reference in its entirety. Any combination of retaining loops and engagement portions described therein can be used in the panels described herein.

Another aspect of the disclosure is a kit of siding panels. The kit includes a plurality of (e.g., at least 10, at least 20, or at least 30) siding panels as otherwise described herein. Notably, the kit does not include a siding panel for which the adhesive does not directly laminate the first edge of the support member to the siding panel with no gap therebetween and the second side edge of the support member to the siding panel with no gap therebetween. That is, the kit includes no siding panels for which an adhesive setback up to 3/16 of an inch is acceptable; rather, each and every siding panel of the kit has the first side edge and the second side edge completely adhered to the siding panel.

Another aspect of the disclosure is a method for manufacturing a kit of siding panels as otherwise described herein. The method includes manufacturing a plurality of siding panels, for each siding panel, the manufacturing including:

providing a siding panel having a front face, a rear face, top edge, a bottom edge, a first side edge, and a second side edge;

providing a support member having a top edge, a bottom edge, a first side edge, a second side edge, a first face, and a second face;

applying adhesive on a first face of the support member from the first side edge of the support member to the second side edge of the support member;

placing the support member on the rear face of the siding panel; and securing the first side edge and the second side edge of the support member to the adhesive; thus laminating the support member to the siding panel.

For each siding panel, it is determinined whether the adhesive directly laminates the first edge of the support member to the siding panel with no gap therebetween and the second side edge of the support member to the siding panel with no gap therebetween. Only the siding panels for which the adhesive directly laminates the first edge of the support member to the siding panel with no gap therebetween and the second side edge of the support member to the siding panel with no gap therebetween are included in the kit. That is, a quality control process can be used to exclude panels for which there is any measurable adhesive setback (i.e., distance over which a side edge is not adhered, forming a gap).

Another aspect of the disclosure is a method for manufacturing a plurality of siding panels (e.g., at least 20 siding panels, at least 50 siding panels, or at least 100 siding panels) as otherwise descrbed herein:

manufacturing a plurality of siding panels, for each siding panel, the manufacturing including:

providing a siding panel having a front face, a rear face, top edge, a bottom edge, a first side edge, and a second side edge;

providing a support member having a top edge, a bottom edge, a first side edge, a second side edge, a first face, and a second face;

applying adhesive on a first face of the support member from the first side edge of the support member to the second side edge of the support member;

placing the support member on the rear face of the siding panel; and securing the first side edge and the second side edge of the support member to the adhesive; thus laminating the support member to the siding panel, In at least 90% (e.g., at least 95%) of the manufactured siding panels the adhesive directly laminates the first edge of the support member to the siding panel with no gap therebetween and the second side edge of the support member to the siding panel with no gap therebetween. That is, the process is performed such that there are fewer than 10% (e.g., fewer than 5%) of the manufactured panels for which there is a measurable adhesive gap at the first side edge and the second side edge of the support member. Critically, the process is performed such that there is no substantial manufacturing tolerance for an adhesive setback (i.e., not even 3/16 of an inch). Rather, the process is performed such that it reproducibly provides siding panels in which there is no measurable adhesive gap at the first side edge and the second side edge of the support member. This can be done, e.g., by over-applying the adhesive so that it goes over the side edges of the support member, as described above.

In various embodiments as otherwise described herein, the support member 114 may be made of any conventional material that can provide rigidity to the siding panel 100. For example, the support member 114 may be made of foam, fiber, mesh, acrylic, polymer, polymer composite, metal, wood, rubber, mineral-filled material, composite material, or combinations thereof. In some embodiments, the support member 114 can be made of any material not susceptible to moisture absorption. In certain embodiments, the support member 114 may be made of any material having a coefficient of linear expansion similar to (e.g., within 15%, within 10%, or even within 5% of) the coefficient of linear expansion of vinyl, or of whatever material the siding panel itself is made.

Figure 6:
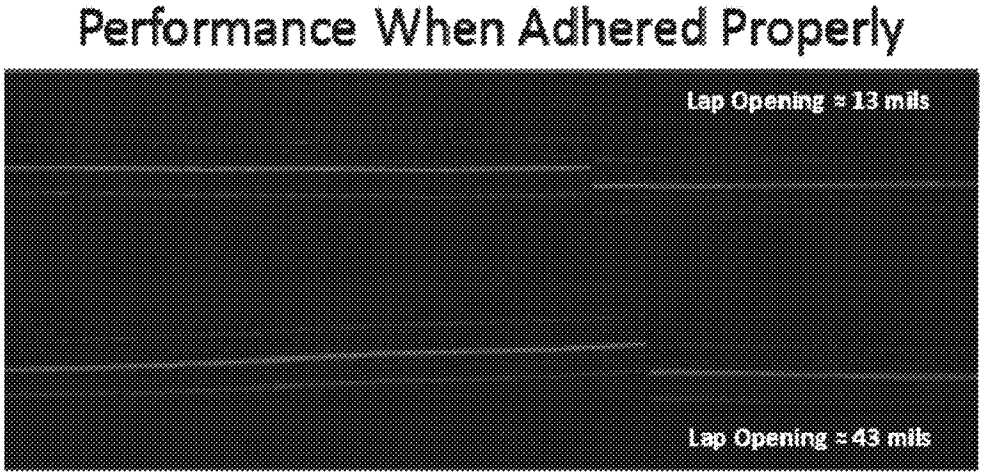
FIG. 6 shows performance test results of properly adhered siding panels.

Notably, testing has shown that the siding panels manufactured according to the above method have a better initial lap appearance, as well as a better lap appearance over time and when exposed to extreme temperatures than the same siding panels when the adhesive was not placed all the way to the edge, and when the support member was not completely secured to the rear face by the adhesive. Some example test results are shown in FIGS. 5 and 6.

Figure 7:
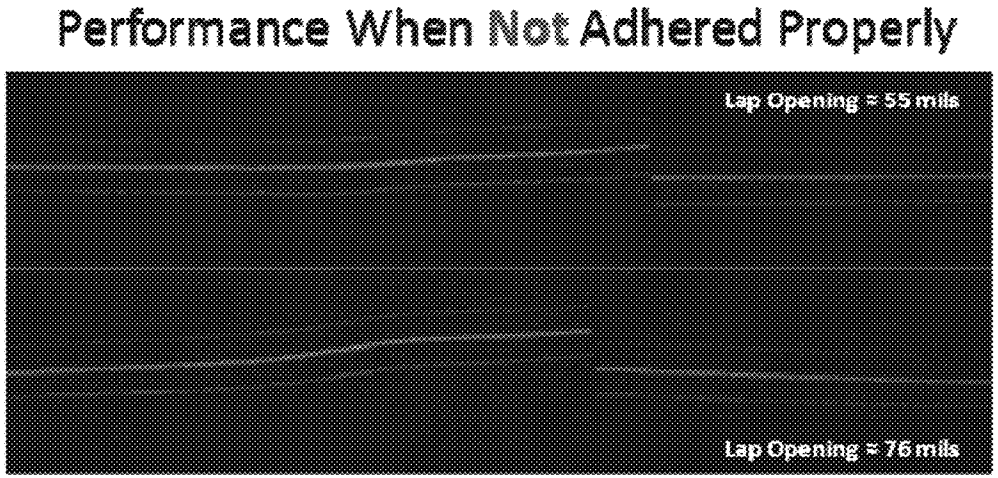
FIG. 7 shows performance test results of improperly adhered siding panels.

In one example, cyclic heat testing was performed. Ten (10) heat cycles were conducted, with the siding panels starting at room temperature, about 75° F., then slowly being heated up to 160° F. and cooled to 75° F. before the next heat cycle. The heating was performed at a slow rate consistent with standard ASTM D7793. The panels that had adhesive placed all the way to the end of one side of the panel (both sides edges of the foam), and where the support member was allowed to completely adhere to the adhesive, had a better overall performance and lap appearance as compared to the panels that did not include adhesive all the way to the side edge or both side edges of the foam, or where the support member was not fully and completely stuck to the rear face of the panel. As shown in FIG. 6, when adhered properly, (i.e., adhesive all the way to side edges of support member and support member completely adhered side edge to side edge of support member on the rear face), the initial lap opening measured approximately 13 mils, and after 10 heat cycles the lap opening measured approximately 43 mils. Also shown, when adhered properly, the noted gradual slope of the line up to the lap opening before and after 10 heat cycles. This gradual slope change will translate into a desirable lap appearance when viewed on a wall of installed siding. However, as shown in FIG. 7, when not adhered properly, (i.e., adhesive not all the way to side edges of support member and support member not completely adhered side edge to side edge of support member on the rear face), the initial lap opening measured approximately 55 mils, and after 10 heat cycles the lap opening measured approximately 76 mils. Also shown, when not adhered properly, there is a sharp slope change to the line before, and an even more dramatic change after 10 heat cycles. This slope change will translate into an imperfection that can be seen with the naked eye on a wall of installed siding.

It should be understood that the siding panels disclosed herein can be made by any known method, such as a known extrusion process, with a common panel size of 8 inches wide by 12 feet long, although other lengths and widths can be used as appropriate.

As the person of ordinary skill in the art will appreciate, the siding panels disclosed herein may be made of conventional materials. For example, the siding panels may be constructed of vinyl, PVC, polymer, polypropylene, acrylic, Acrylonitrile Styrene Acrylate (ASA), fiberglass, aluminum, steel, any other plastic, or metal, or combinations thereof, or any other material that requires the siding panels to overlap during installation. Conventional methodologies for siding construction can be used in the siding panels as described herein.

It should be understood that in alternative embodiments, any suitable fastening mechanism may be used to secure the support member to the rear face 104. For example, in some embodiments, the support member 114 may be fused to, poured onto, co-extruded, laminated, welded, mechanically joined, or injection molded onto the rear face 104 of the siding panel 100.

Additional aspects of the disclosure are provided by the following enumerated embodiments, which can be combined and permuted in any number and in any combination that is not technically or logically inconsistent.

Embodiment 1

A method manufacturing a siding panel, the method comprising:

providing a siding panel having a front face, a rear face, top edge, a bottom edge, a first side edge, and a second side edge;

providing a support member having a top edge, a bottom edge, a first side edge, a second side edge, a first face, and a second face;

applying adhesive on a first face of the support member from the first side edge of the support member to the second side edge of the support member;

placing the support member on the rear face of the siding panel;

completely securing the two side edges of a support member to the adhesive; thus laminating the support member to the siding panel, such that the adhesive directly laminates the first edge of the support member to the siding panel with no gap therebetween and the second side edge of the support member to the siding panel with no gap therebetween.

Embodiment 2

The method of embodiment 1, wherein the support member is placed such that it extends substantially from the first side edge of the siding panel (e.g., within ¼ inch) to about ½ in. to about 2¼ in. away from the second side edge of the siding panel.

Embodiment 3

The method of embodiment 1, wherein the support member is placed such that each of the first and second side edges of the support panel is positioned within about ½ inch to about 2¼ inches way from the respective side edge of the siding panel.

Embodiment 4

The method of any of embodiments 1-3, further comprising applying the adhesive over at least one of the side edges of the support member.

Embodiment 5

The method of any of embodiments 1-4, further comprising applying the adhesive over both side edges of the support member.

Embodiment 6

The method of any of embodiments 1-5, wherein the support member comprises foam, fiber, mesh, acrylic, polymer, polymer composite, metal, wood, rubber, mineral-filled material, composite material, or combinations thereof.

Embodiment 7

The method of any of embodiments 1-6, wherein the support member comprises a foam material.

Embodiment 8

The method of any of embodiments 1-7, wherein the top edge of the siding panel includes a nail hem.

Embodiment 9

The method of any of embodiments 1-8, wherein the support member extends from about ¼ in. to about 5 in. below the top edge of the siding panel to about 0 in. to 8 in. away from the bottom edge of the siding panel.

Embodiment 10

The method of any of embodiments 1-9, wherein the thickness of a largest section of the support member is in the range of about ⅛ in. to about ¾ in.

Embodiment 11

The method of any of embodiments 1-10, wherein the length of the support member is in the range of about 2 in. to about 24 in.

Embodiment 12

The method of any of embodiments 1-11, wherein the front face of the siding panel comprises an upper region and a lower region.

Embodiment 13

The method of embodiment 12, wherein the width of the upper region is in the range of about 2 in. to about 10 in.

Embodiment 14

The method of embodiments 12 or 13, wherein the width of the lower region is in the range of about 2 in. to about 10 in.

Embodiment 15

The method of any of embodiments 1-14, wherein the adhesive comprises a hot melt moisture cured adhesive, a hot melt adhesive, a pressure-sensitive adhesive, a contact adhesive, a adhesive film, a solvent-based adhesive, a two-part adhesive, a water-based adhesive, a cyanoacrylate adhesive, or combinations thereof.

Embodiment 16

The method of any of embodiments 1-15, wherein the siding panel is constructed of vinyl, PVC, polymer, polypropylene, acrylic, Acrylonitrile Styrene Acrylate (ASA), fiberglass, aluminum, steel, any other plastic, or metal, or combinations thereof.

Embodiment 17

The method of any of embodiments 1-16, wherein the support member is constructed of a material having a coefficient of linear expansion similar to the coefficient of linear expansion of the material of the siding panel.

Embodiment 18

A method for installing the siding panel claimed in any of embodiments 1-17.

Embodiment 19

A siding panel comprising:

a front face;

a rear face having a support member completely secured thereto, the support member having adhesive on a first face of the support member from a first side edge of the support member to a second side edge of the support member, such that the adhesive directly laminates the first side edge of the support member to the siding panel with no gap therebetween and the second side edge of the support member to the siding panel with no gap therebetween;

a top edge including a nail hem;

a bottom edge;

a first side edge; and a second side edge, and wherein the support member ends below the nail hem.

Embodiment 20

The siding panel of embodiment 19, wherein the support member extends substantially from the first side edge of the siding panel (e.g., within ¼ inch) to about % in. to about 2¼ in. away from the second side edge.

Embodiment 21

The siding panel of embodiment 19, wherein the support member is placed such that each of the first and second side edges of the support panel is positioned within about ½ inch to about 2¼ inches way from the respective side edge of the siding panel.

Embodiment 22

The siding panel of any of embodiments 19-21, wherein the support member extends from about ¼ in. to about 5 in. below the top edge of the siding panel to about 0 in. to 8 in. away from the bottom edge of the siding panel.

Embodiment 23

The siding panel of any of embodiments 19-22, wherein the adhesive is applied over at least one side edge of the support member.

Embodiment 24

The siding panel of any of embodiments 19-23 wherein the adhesive is applied over both side edges of the support member.

Embodiment 25

The siding panel of any of embodiments 19-24, wherein the support member comprises a foam, fiber, mesh, acrylic, polymer, polymer composite, metal, wood, rubber, mineral-filled material, composite material, or combinations thereof.

Embodiment 26

The siding panel of any of embodiments 19-25, wherein the length of the support member is in the range of about 2 in. to about 24 in.

Embodiment 27

The siding panel of any of embodiments 19-26, wherein both side edges of the support member are secured to the rear face of the siding panel.

Embodiment 28

The siding panel of any of embodiments 19-27, wherein the thickness of a largest section of the support member is in the range of about ⅛ in. to about ¾ in.

Embodiment 29

The siding panel of any of embodiments 19-28, wherein the siding panel is constructed of vinyl, PVC, polymer, polypropylene, acrylic, Acrylonitrile Styrene Acrylate (ASA), fiberglass, aluminum, steel, any other plastic, or metal, or combinations thereof.

Embodiment 30

The siding panel of any of embodiments 19-29, wherein the support member is constructed of a material having a coefficient of linear expansion similar to the coefficient of linear expansion of the material of the siding panel.

Embodiment 31

A method for installing the siding panel claimed in any of embodiments 19-30.

Embodiment 32

A method for manufacturing the siding panel claimed in any of embodiments 19-31.

Embodiment 33

A kit of siding panels, the kit including a plurality of (e.g., at least 10, at least 20, or at least 30) siding panels of any of embodiments 19-31, wherein the kit does not include a siding panel for which the adhesive does not directly laminate the first edge of the support member to the siding panel with no gap therebetween and the second side edge of the support member to the siding panel with no gap therebetween.

Embodiment 34

A method for manufacturing a kit of siding panels as claimed in any of embodiments 19-31, comprising:

manufacturing a plurality of siding panels, for each siding panel, the manufacturing including:

providing a siding panel having a front face, a rear face, top edge, a bottom edge, a first side edge, and a second side edge;

providing a support member having a top edge, a bottom edge, a first side edge, a second side edge, a first face, and a second face;

applying adhesive on a first face of the support member from the first side edge of the support member to the second side edge of the support member;

placing the support member on the rear face of the siding panel; and securing the first side edge and the second side edge of the support member to the adhesive; thus laminating the support member to the siding panel, for each siding panel determining whether the adhesive directly laminates the first edge of the support member to the siding panel with no gap therebetween and the second side edge of the support member to the siding panel with no gap therebetween; and including in the kit only siding panels for which the adhesive directly laminates the first edge of the support member to the siding panel with no gap therebetween and the second side edge of the support member to the siding panel with no gap therebetween.

Embodiment 35

A method for manufacturing a plurality of siding panels (e.g., at least 20 siding panels, at least 50 siding panels, or at least 100 siding panels) as claimed in any of embodiments 19-31, comprising:

manufacturing a plurality of siding panels, for each siding panel, the manufacturing including:

providing a siding panel having a front face, a rear face, top edge, a bottom edge, a first side edge, and a second side edge;

providing a support member having a top edge, a bottom edge, a first side edge, a second side edge, a first face, and a second face;

applying adhesive on a first face of the support member from the first side edge of the support member to the second side edge of the support member;

placing the support member on the rear face of the siding panel; and securing the first side edge and the second side edge of the support member to the adhesive; thus laminating the support member to the siding panel, wherein in at least 90% (e.g., at least 95%) of the manufactured siding panels the adhesive directly laminates the first edge of the support member to the siding panel with no gap therebetween and the second side edge of the support member to the siding panel with no gap therebetween.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A siding panel comprising:

a front face;

a rear face having a support member completely secured thereto, the support member having adhesive on a first face of the support member from a first side edge of the support member to a second side edge of the support member, such that the adhesive directly laminates the first side edge of the support member to the siding panel with no gap therebetween with no margin of error, and the second side edge of the support member to the siding panel with no gap therebetween with no margin of error;

a top edge including a nail hem;

a bottom edge;

a first side edge; and a second side edge, and wherein the support member ends below the nail hem.

2. The siding panel of claim 1, wherein the support member extends substantially from within ¼ inch from the first side edge of the siding panel to about ½ in. to about 2¼ in. away from the second side edge of the siding panel.

3. The siding panel of claim 1, wherein the support member is placed such that each of the first and second side edges of the support panel is positioned within about ½ inch to about 2¼ inches way from the respective side edge of the siding panel.

4. The siding panel of claim 1, wherein the support member extends from about ¼ in. to about 5 in. below the top edge of the siding panel to about 0 in. to 8 in. away from the bottom edge of the siding panel.

5. The siding panel of claim 1, wherein the adhesive is applied over at least one side edge of the support member.

6. The siding panel of claim 1, wherein the adhesive is applied over both side edges of the support member.

7. The siding panel of claim 1, wherein the support member comprises a foam, fiber, mesh, acrylic, polymer, polymer composite, metal, wood, rubber, mineral-filled material, composite material, or combinations thereof.

8. The siding panel of claim 1, wherein the length of the support member is in the range of about 2 in. to about 24 in.

9. The siding panel of claim 1, wherein both side edges of the support member are at least partially secured to the rear face of the siding panel.

10. The siding panel of claim 1, wherein the thickness of a largest section of the support member is in the range of about ⅛ in. to about ¾ in.

11. The siding panel of claim 1, wherein the siding panel is constructed of vinyl, PVC, polymer, polypropylene, acrylic, Acrylonitrile Styrene Acrylate (ASA), fiberglass, aluminum, steel, any other plastic, or metal, or combinations thereof.

12. A kit of siding panels, the kit including at least 10 siding panels of claim 1, wherein the kit does not include a siding panel for which the adhesive does not directly laminate the first edge of the support member to the siding panel with no gap therebetween and the second side edge of the support member to the siding panel with no gap therebetween.

13. A method for manufacturing a kit of siding panels as claimed claim 1, the method comprising:

manufacturing a plurality of siding panels, for each siding panel, the manufacturing including:

providing a siding panel having a front face, a rear face, top edge, a bottom edge, a first side edge, and a second side edge;

providing a support member having a top edge, a bottom edge, a first side edge, a second side edge, a first face, and a second face;

applying adhesive on a first face of the support member from the first side edge of the support member to the second side edge of the support member;

placing the support member on the rear face of the siding panel; and securing the first side edge and the second side edge of the support member to the adhesive; thus laminating the support member to the siding panel, for each siding panel determining whether the adhesive directly laminates the first edge of the support member to the siding panel with no gap therebetween and the second side edge of the support member to the siding panel with no gap therebetween; and including in the kit only siding panels for which the adhesive directly laminates the first edge of the support member to the siding panel with no gap therebetween and the second side edge of the support member to the siding panel with no gap therebetween.

14. A method for manufacturing at least 100 siding panels each as claimed in claim 1, the method comprising:

manufacturing at least 100 siding panels, for each siding panel, the manufacturing including:

providing a siding panel having a front face, a rear face, top edge, a bottom edge, a first side edge, and a second side edge;

providing a support member having a top edge, a bottom edge, a first side edge, a second side edge, a first face, and a second face;

applying adhesive on a first face of the support member from the first side edge of the support member to the second side edge of the support member;

placing the support member on the rear face of the siding panel; and securing the first side edge and the second side edge of the support member to the adhesive; thus laminating the support member to the siding panel, wherein in at least 90% of the manufactured siding panels the adhesive directly laminates the first edge of the support member to the siding panel with no gap therebetween and the second side edge of the support member to the siding panel with no gap therebetween.

15. A method manufacturing a siding panel according to claim 1, the method comprising:

providing a siding panel having a front face, a rear face, top edge, a bottom edge, a first side edge, and a second side edge;

providing a support member having a top edge, a bottom edge, a first side edge, a second side edge, a first face, and a second face;

applying adhesive on a first face of the support member from the first side edge of the support member to the second side edge of the support member;

placing the support member on the rear face of the siding panel;

completely securing the two side edges of a support member to the adhesive; thus laminating the support member to the siding panel, such that the adhesive directly laminates the first edge of the support member to the siding panel with no gap therebetween and the second side edge of the support member to the siding panel with no gap therebetween.

16. The method of claim 15, wherein the support member is placed such that it extends substantially from within ¼ inch from the first side edge of the siding panel to about ½ in. to about 2¼ in. away from the second side edge of the siding panel.

17. The method of claim 15, wherein the support member is placed such that each of the first and second side edges of the support panel is positioned within about ½ inch to about 2¼ inches way from the respective side edge of the siding panel.

18. The method of claim 15, further comprising applying the adhesive over at least one of the side edges of the support member.

19. The method of claim 15, further comprising applying the adhesive over both side edges of the support member.

20. The method of claim 15, wherein the support member comprises a foam material.

* * * * *